United States Patent [19]

Werner

[11] 4,228,907

[45] Oct. 21, 1980

[54] MINIATURE RAILROAD UNCOUPLING APPARATUS

[76] Inventor: John Werner, 11455 Tampa St., Northridge, Calif. 91324

[21] Appl. No.: 869,645

[22] Filed: Jul. 17, 1978

[51] Int. Cl.[3] ..... B61G 1/00; B61G 3/00; B61G 5/00; B61G 7/00

[52] U.S. Cl. ..... 213/75 TC; 213/211

[58] Field of Search ..... 213/75 TC, 211, 216, 213/217, 218; 46/216, 217, 218

[56] References Cited

U.S. PATENT DOCUMENTS

| | | | |
|---|---|---|---|
| 2,263,959 | 11/1941 | Tyler | 213/75 TC X |
| 3,134,489 | 5/1964 | Gillham | 213/211 |

*Primary Examiner*—Douglas C. Butler
*Attorney, Agent, or Firm*—W. Charles Porter

[57] ABSTRACT

A portable uncoupling device comprising a raised resilient strap attached to a self locating base and used to uncouple miniature railroad cars where the two couplers connecting two railroad cars each have one lift pin located on opposite sides of the centerline running between the rails of a miniature railroad track. The raised resilient strap is secured at one end to the self locating base, the other end of the strap touching the base but being able to slide freely along it so as not to buckle as the raised straps is depressed. The base has crimped ends to secure it between two railroad ties and sufficient width to allow it to fit snugly between the rails. The resilient strap has a width slightly greater than half the width of the base and is positioned so that it lifts only one lift pin of two connected couplers and provides support below the center of mass of the railroad cars passing over it. The strap is curved on the end where it touches the base so that it can slide freely as it flexes up and down under the weight of the miniature railroad cars passing over it. Notches in the sides of the base permit the uncoupler to be installed in curved sections of track as well as straight ones.

11 Claims, 3 Drawing Figures

MINIATURE RAILROAD UNCOUPLING APPARATUS

FIELD OF THE INVENTION

This invention relates to uncoupling devices for miniature railroads. More specifically, the invention is a portable uncoupler for use with miniature railroad car couplers where the two couplers connecting two cars each have a lift pin which extends vertically below the coupler. Force applied upwards against one of these pins causes the coupler to pivot up and disengage the other coupler. The lift pins of connecting couplers are each located on opposite sides of the centerline between the rails of the track. An example of this type of coupler is the Rapido coupler for N scale miniature railroad systems as manufactured by Atlas Tool and Die Company of Hillside, New Jersey.

BACKGROUND OF THE INVENTION

Uncoupler devices for miniature railroad cars are generally permanently attached to a piece of miniature railroad track which is part of the miniature railroad track circuit. In order to move the uncoupler from one location to another within the track circuit or system, it is necessary to partially disassemble the system to remove the piece of track with the uncoupler attached and install it elsewhere in the circuit. This is a relatively time consuming and cumbersome procedure which limits the versatility of the track operator in uncoupling cars at various places within the circuit.

Most uncoupling devices have several moving parts and are manually operated, or by remote control. To avoid derailing of the cars, these uncouplers must be actuated while the particular coupler of the railroad car is directly over the uncoupling apparatus. This has a disadvantage of having to time the precise moment to activate the uncoupler in order to achieve the desired separation in the chain of miniature railroad cars.

Most miniature railroad uncouplers have the additional disadvantage that they cannot be used with curved track. Miniature railroad systems therefore are usually designed with the constraint that all desired uncoupling will have to be done in a straight portion of the track system.

Most uncoupling devices for miniature railroad car uncouplers of the type discussed here are relatively expensive due to the number of moving parts involved and the fact that it must be manufactured permanently attached to a piece of railroad track. Further, in order to have a great deal of versatility in the miniature railroad system, a large number of these permanent installations must be employed.

Since the introduction of Rapido type couplers, a satisfactory portable uncoupler has not been available. Portable uncoupling devices for other coupling systems have been proposed, but none has been able to overcome the problems described above and still function with the Rapido coupler design. For example, the portable uncoupler described in the Pat. No. 2,263,959, by J. N. Tyler, entitled "Car Coupling and Uncoupling Mechanism," utilizes a raised resilient strap attached to a portable base. However, the strap is designed to deflect only a small amount. Used with the Rapido coupler, the strap would have to be raised sufficiently to lift the coupler pins, but be able to deflect enough to allow the cars' axles to pass over without derailing. The relatively large amount of deflection required causes the resilient strap to "pop" or "oil can." This popping results in erratic performance of the uncoupler and can cause derailment of the miniature railroad cars.

SUMMARY OF THE INVENTION

A principal feature of this invention is to provide a portable uncoupler for use with the above-mentioned Rapido type coupling devices on miniature railroad cars. The uncoupler may be moved from one section of the miniature railroad system to another without disassembly of the track. An important aspect of the invention is that it is capable of uncoupling two miniature railroad cars by use of a raised flexible resilient strap attached to a base which fits between the two rails of the railroad track. The raised strap depresses sufficiently under the weight of the axles of the railroad cars as they pass over so as not to derail the cars, but has the requisite stiffness to raise the uncoupling devices of the cars to enable them to separate.

Another important aspect of the invention is that the flexible strap extends from side of the space between the two rails to slightly past the centerline. This is to provide for light railroad cars being raised off the track due to the pressure of the strap against the axles. The strap provides support beneath the car's center of mass so that the car will not derail. The width of the strap must be only slightly greater than half the distance between the two rails so that only one coupling device between the two cars is raised.

A further aspect of the invention is that the flexible strap mounted on the base has two ramps along which the miniature cars' coupler lift pins are raised and lowered and which permits the railroad cars axles to depress it gradually so that a sudden shock does not derail the cars. Another aspect of the invention is that the flexible strap is fixedly attached to its base at one end while it rides freely at the other end. This prevents buckling and popping when the strap is depressed and facilitates smooth and gradual deflection as the railroad car axles depress it.

Another aspect of the invention is that the base has spaces or notches cut out in its sides so that it can be placed in straight track sections as well as curved ones. This feature adds versatility to the miniature railroad system by permitting uncoupling on curves as well as straight sections.

A further aspect of the invention is that the base has its ends crimped such that it can be secured to the railroad ties in the miniature railroad track. The width of the base is the same as the width between the two rails so that the uncoupler is self locating when installed.

Other objects, features and advantages of the invention will become apparent from the drawings and detailed description of the invention.

DETAILED DESCRIPTION OF THE INVENTION

Figure 1:
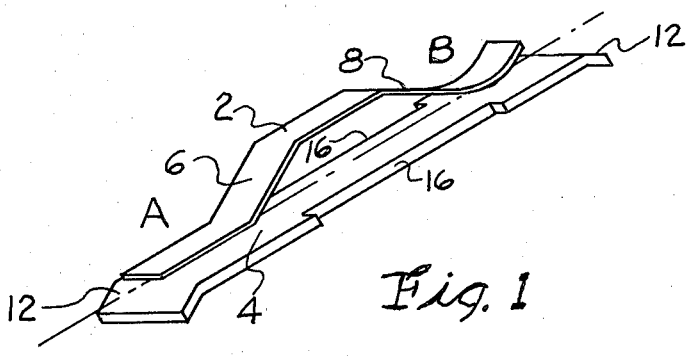
FIG. 1 is an illustration of the portable uncouplers assembly with the flexible strap mounted to its base.

In FIG. 1 a flexible strap 2 extending from point A to point B is attached to a base 4. This assembly constitutes an uncoupler for the above-referenced Rapido type coupling devices for miniature railroads. The flexible strap 2 is made of a resilient material such as aluminum 0.001 inch thick and the base 4 maybe made of a commonly available glass laminate or other suitable nonconducting material. The strap 2 is secured to the nonconducting base at point A with epoxy glue while the other end at point B is free to slide against the base 4 as the strap is depressed towards the base. By being secured at only one end, the strap can be depressed more easily and it returns to its original shape gradually when the force is removed or decreased.

The strap is shaped such that anti-derailing ramps 6 and 8 are formed. These ramps allow the axles of miniature railroad cars to ride over the uncoupler smoothly by increasing and decreasing the force gradually as they ride up one ramp and down the other. This reduces or eliminates the cars from being raised off of the track and greatly decreases any shock associated with encountering of the uncoupler so as to prevent derailment of the cars.

The strap width is slightly greater than one half of the width of the base 4, and is positioned to one side, extending slightly over the centerline of the base. By being positioned to one side the strap engages only one of the lift pins of the couplers connecting a pair of miniature railroad cars.

The strap is designed to be flexible enough that it depresses sufficiently under the weight of the railroad cars axles so that the wheels of the cars do not raise off of the track as the axles go over the uncoupler. However, if the wheels raise slightly off of the track, the strap extends slightly over the centerline of the base and is therefore beneath the center mass of the car. In this manner, the strap supports the car in a way that prevents tipping and derailment.

Also, it is noted that the resilient strap 2 is curved at point B where it touches the base 4. This allows the strap to slide easily along the base 4 without snagging or binding as the strap is depressed or returns to its original shape.

Figure 2:
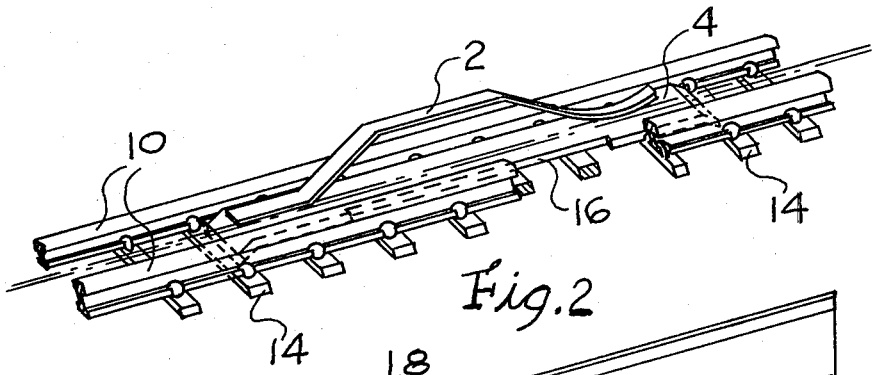
FIG. 2 shows the uncoupler installed in a section of the miniature railroad track.

FIG. 2 shows the uncoupler installed in a portion of the miniature railroad track circuit. The base 4 fits snugly between two pieces of track 10 and the crimped ends 12 of the base secure the uncoupler in the railroad ties 14. The base 4 is wide enough at its ends so that the rails 10 restrict side movement of the uncoupler to a range that the strap 2 will provide support below the cars' center of mass and will not engage more than one lift pin simultaneously. Also note that notches 16 are cut out of the sides of the base 4 to permit the uncoupler to be installed in a curved section of the track as well as a straight one.

Figure 3:
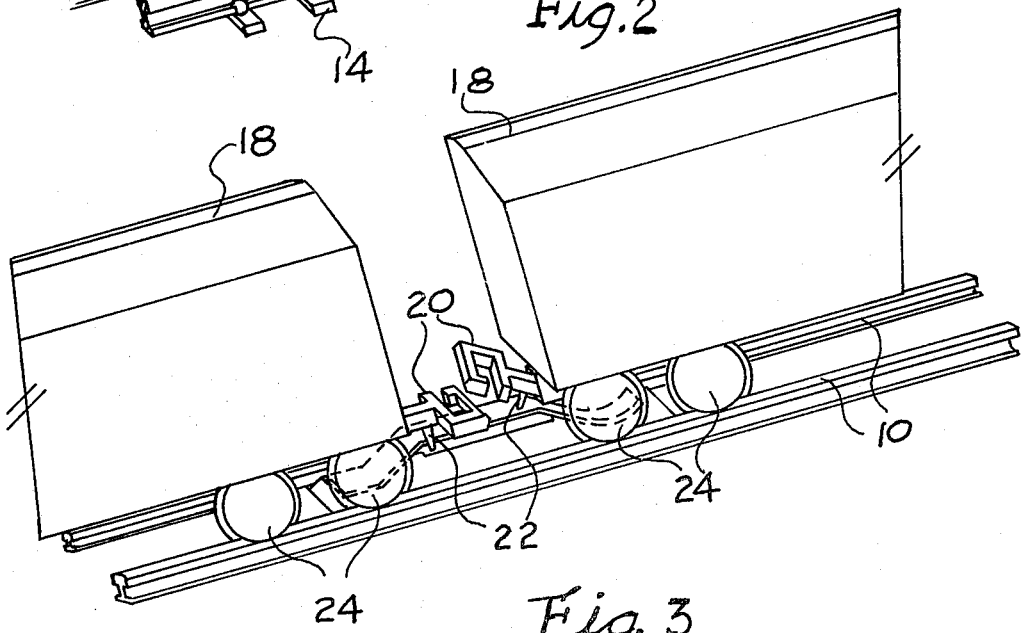
FIG. 3 shows two railroad cars with the Rapido type coupling devices being disconnected as their lift pins engage the flexible strap of the uncoupler.

FIG. 3 shows two miniature railroad cars 18 with Rapido couplers 20 connecting them. In the view shown, one of the lift pins 22 of the couplers is engaging the uncoupling device and lifting it high enough to disengage from the other coupler 20. It is noted that the lift pins 22 on the couplers 20 are located on opposite sides of the centerline running between the rails 10. Due to the fact that the resilient strap 2 of the uncoupler covers only half of the space between the rails, it lifts only one of the pins 22. If both pins were lifted simultaneously, the couplers 20 would remain engaged and the uncoupler would not perform its function.

The flat portion in the center of the raised resilient strap 2 between the ramps 6 and 8 is of sufficient length to permit the couplers 20 to remain disengaged for a sufficient amount of time to permit the cars 18 to move enough with respect to one another so that the couplers 20 do not reengage. While the coupler is raised passing over the uncoupler, the motion of one of the cars 18 will be impeded by the axles of the wheels 24 coming in contact with the ramps 6 and 8. This causes the two cars 18 to move at different rates and further facilitates sufficient separation to prevent the couplers 20 from reengaging each other after passing over the uncoupler.

What is claimed is:

1. A portable uncoupling apparatus for use with a miniature railroad system comprising:

base means for locating and securing the apparatus when placed between two rails of a miniature railroad track to restrict side motion; and a resilient strap having a width less than the distance between the rails and having a raised portion along its length and inclines forming ramps on either side of the raised portion's highest point, said strap being attached to the base means on one side of the raised portion whereby the strap may be depressed towards the base means without buckling, and said strap being oriented along the base means with its length substantially parallel to the rails and being positioned to one side between said rails whereby the strap lifts only one of at least two vertical lift pins of two engaged couplers between connecting miniature railroad cars, said strap having adequate stiffness to raise the lift pin but sufficient flexibility to depress under the weight of axles of miniature railroad cars passing over the strap.

2. The uncoupling apparatus described in claim 1 wherein said strap extends over the centerline between the rails thereby contacting the axles of the cars below their center of mass and preventing derailing.

3. The uncoupling apparatus described in claim 1 wherein said resilient strap is a metal strap.

4. The uncoupling apparatus described in claim 1 where said resilient strap is an aluminum strap substantially 0.001 inch thick.

5. The uncoupling apparatus described in claim 1 wherein the base means is a nonconducting board with a width at its ends slightly less than the distance between rail attachments fastening the rails to the base whereby the base fits snugly between the rail attachments and is self locating with respect to side motion between the rails.

6. The uncoupling apparatus described in claim 5 wherein said nonconducting board is made of a glass laminate material.

7. The uncoupling apparatus described in claim 5 wherein said nonconducting board further includes crimped ends whereby the board is secured between ties of the miniature railroad track.

8. The uncoupling apparatus described in claims 5 further including at least one notch in the sides of said nonconducting board whereby said uncoupling apparatus may be installed in curved sections of track as well as straight sections.

9. The uncoupling apparatus described in claim 5 wherein said resilient strap is formed with its raised portion substantially flat and in a plane substantially parallel to the nonconducting board and the inclines connecting the raised portion to the board being substantially straight.

10. The uncoupling apparatus described in claim 1 wherein said resilient strap slideably touches said base means on a side of the raised portion of the strap opposite from the side where the strap is fixedly attached to the base means, whereby the strap slides against the base means at the point where the strap slideably touches the base as the raised portion of the strap is depressed towards the base means.

11. A portable uncoupling apparatus for use with a miniature railroad system comprising:

a self locating base made of a nonconducting material having a width slightly less than the distance between the rail attachments of the track of said system and having at least one notch in its sides whereby the base fits snugly between rail attachments which fasten the rails to the base placed in curved sections of track as well as straight sections; and a resilient strap having a width substantially half the distance between two rails in the system and being formed to provide a raised portion along its length and inclines forming ramps on either side of the highest point of the raised portion, said strap being fixedly attached to the self locating base on one side of the raised portion and free to move on the other side whereby the strap may be depressed towards the base without buckling, said strap being oriented substantially parallel to the rails when the base is installed in the track, said strap also being located to one side of the base whereby the strap lifts only the lift pin of one of two engaged couplers between miniature railroad cars, said strap further extending over the centerline between the rails thereby contacting axles of miniature railroad cars below their center of mass and preventing derailing, and said strap having adequate stiffness to raise one of two vertical lift pins, but sufficient flexibility to depress under the weight of the miniature railroad car axles passing over the uncoupling apparatus.

* * * * *